US006971741B2

(12) United States Patent
Nanjo et al.

(10) Patent No.: US 6,971,741 B2
(45) Date of Patent: Dec. 6, 2005

(54) LIQUID STORAGE CONTAINER

(75) Inventors: Tatsuo Nanjo, Kanagawa (JP); Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 10/470,632

(22) Filed: Nov. 24, 2003

(65) Prior Publication Data

US 2005/0174396 A1 Aug. 11, 2005

(30) Foreign Application Priority Data

Nov. 27, 2002 (JP) ..... 2002-344506

(51) Int. Cl.[7] ..... B41J 2/175
(52) U.S. Cl. ..... 347/85
(58) Field of Search ..... 347/85, 86, 87; 141/2, 18; 222/1

(56) References Cited

U.S. PATENT DOCUMENTS 4,096,971 A * 6/1978 Kuckens ..... 222/1
4,412,233 A * 10/1983 Thomas et al. ..... 347/85
5,561,453 A * 10/1996 Shibata et al. ..... 347/85
6,325,496 B1 * 12/2001 Kageyama et al. ..... 347/85

FOREIGN PATENT DOCUMENTS

JP 2001-270131 10/2001

* cited by examiner

*Primary Examiner*—Anh T. N. Vo
(74) *Attorney, Agent, or Firm*—Fitzpatrick, Cella, Harper & Scinto

(57) ABSTRACT

A hollow tubular member 170 is provided in the interior of the container 100 having a liquid-supply port 106 underside thereof as seen in the vertical direction, which tubular member is connected at one end to the liquid-supply port 106 and has a float 180 at the other end. Liquid-supply holes 190 and 191 are provided in the tubular member at positions in the vicinity of the float and in the vicinity of the liquid-supply port, respectively. The tubular member is raised vertically upward by the buoyancy of the float. Since the position of the float descends as the surface level of liquid stored in the container descends, the tubular member deforms therewith so that the liquid-supply holes are always located in specific concentration layers, respectively, to be capable of taking the liquid having specific concentrations into the tubular member.

11 Claims, 9 Drawing Sheets

LIQUID STORAGE CONTAINER

This application claims priority from Japanese Patent Application No. 2002-344506 filed Nov. 27, 2002, which is incorporated hereinto by reference.

BACKGROUND OF THE INVENTION

1. Field of the Invention

The present invention relates to a liquid storage container for storing liquid forming a plurality of layers of different concentrations. More specifically, the present invention relates to a liquid storage container for storing liquid such as ink used to supply the ink to a printing head of an ink jet printer. More particularly, the present invention relates to a liquid storage container for storing ink containing pigment as a colorant.

2. Description of the Related Art

The ink jet printer forms an image on a print medium by ejecting ink from a plurality of ejection orifices provided in a printing head onto a printing medium. There are two types of ink tank for supplying ink to the printing head in this ink jet printer; one has a relatively small capacity and is adapted to be mounted on a carriage together with the printing head, and the other has a relatively large capacity and is adapted not to be mounted on a carriage but supply ink to the printing head via a feeding member. This ink tank having a relatively large capacity and not mounted on the carriage is often coupled in a detachable manner to an end of an ink supplying system for supplying ink used for the printing operation to the printing head. In the conventional detachable type ink tank, there have been known a type provided with a member for generating a capillary force, such as sponge, within the interior of the ink tank and retaining ink therein, and a type formed of a flexible bag or a rigid housing within which directly stores ink. Particularly, in a wide-format printer having a large ink consumption volume per one page or in a network printer having a high operating efficiency, a large amount of ink is required. Accordingly, in view of reducing the frequency for exchanging ink tanks and improving the ink storage efficiency, an ink tank of a type capable of directly storing ink without accommodating sponge or the like in the tank has been desired.

Ink of a paper-permeable type has been widely used as a colorant for the conventional ink jet printer in view of the ink fixation or the color development on the medium surface after the printing.

Printed products printed with ink using a dye as a colorant, however, have poor light, gas and the water resistance. While ink using a pigment as a colorant has been developed to solve such a problem, this ink has not become widespread. One reason therefore is that pigment particles are settled in static state of the ink tank for a long period. When the pigment particles have been settled out, there is the gradient of the ink concentration in the upward/downward direction in the interior of the ink tank, resulting in a visible color difference between the initial and final stages of the use of the ink tank. This phenomenon is particularly problematic in color ink decisive of tint.

As a countermeasure against the problem caused by the settlement of the pigment particles, there is a proposal as shown in FIG. 8 (for example, see Japanese Patent Application Laid-open No. 2001-270131) in which a hollow tubular member having a number of ink-supply holes on the circumference thereof is disposed in an ink-supply port. By using this structure, amounts of ink having the different concentrations, respectively, in correspondence to the positions of the ink-supply holes are sucked therefrom and, as a result, it is possible to suck the amounts of ink from the respective concentration layers, which are mixed together in the tubular member to form ink having the averaged concentration which is supplied to the printing head.

However, as the ink is consumed in the printing head, the ink stored in the ink tank is also consumed, whereby there may be a case in which the concentration of ink sucked from the same ink-supply hole is different in accordance with levels of the ink surface as shown in FIGS. 9A and 9B. That is, while the same ink-supply holes (three ink-supply holes from the lowermost (a first) one to a third one) are used for sucking ink at the ink surface level A in FIG. 9A and at the ink surface level B in FIG. 9B, the concentration layers from which the ink is sucked are different between the ink surface levels A and B. Namely, at the ink surface level A, ink of a medium concentration and a high concentration is sucked, and at the ink surface level B, ink of a low concentration is also sucked in addition to the former two. As a result, there might be a risk in that the concentration of ink flowing into the tubular member is more or less changed. In other words, since the ink surface level changes as the ink is consumed while the position of the ink-supply hole is stationary, the positional relationship might vary between the respective ink-supply holes and the distribution of ink concentration, resulting in the variation of ink concentration to be supplied.

Also, when the ink-supply port is located in an upper portion of the ink tank, the tubular shape could not be adopted as it is, which restricts the degree of design freedom.

SUMMARY OF THE INVENTION

The present invention has been made to solve the above-mentioned problems, and an object thereof is to provide a liquid storage container capable of supplying pigment ink having a constant pigment concentration free from the variation to a printing head throughout the use from the initial stage to the final stage even if the settlement of the pigment ink occurs. Also, another object of the present invention is to provide a liquid storage container capable of supplying the pigment ink having a constant pigment concentration even if the ink-supply holes are located at any positions.

That is, the object is to provide a liquid storage container capable of always supplying liquid having a constant concentration free from the variation when the liquid is taken out from the liquid storage container for storing such liquid as having a tendency of forming a plurality of concentration layers by the settlement of pigment.

[Patent Document]

Japanese Patent Application Laid-open No. 2001-270131.

The inventive liquid storage container for storing liquid having a tendency of forming a plurality of concentration layers when settled out, each having a concentration different from the other, provided with a liquid-supply port for supplying the liquid to another device, comprises a hollow tubular member disposed in the interior of the liquid storage container and connected at one end to the liquid-supply port, and at least one liquid-supply hole formed in the tubular member; wherein a height of the at least one liquid-supply hole from the bottom of the liquid storage container varies in accordance with the change of a level of the liquid surface, whereby the liquid in a specific layer of the plurality of concentration layers is taken into the tubular member from the at least one liquid-supply hole.

According to the above structure, even if the ink surface level changes, it is possible to always collect the liquid from the same concentration layer, whereby the liquid of the constant concentration is supplied to other devices.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described below based on the preferred embodiments with reference to the attached drawings.

While ink tanks are used as a representative of liquid storage containers in the following embodiments, it should be noted that the present invention is applicable not only to the ink tank but also to other containers having a mechanism for storing liquid forming a plurality of concentration layers and supplying the same to other devices.

A whole structure of the ink tank according to the preferred embodiment of this invention will be explained.

Figure 1:
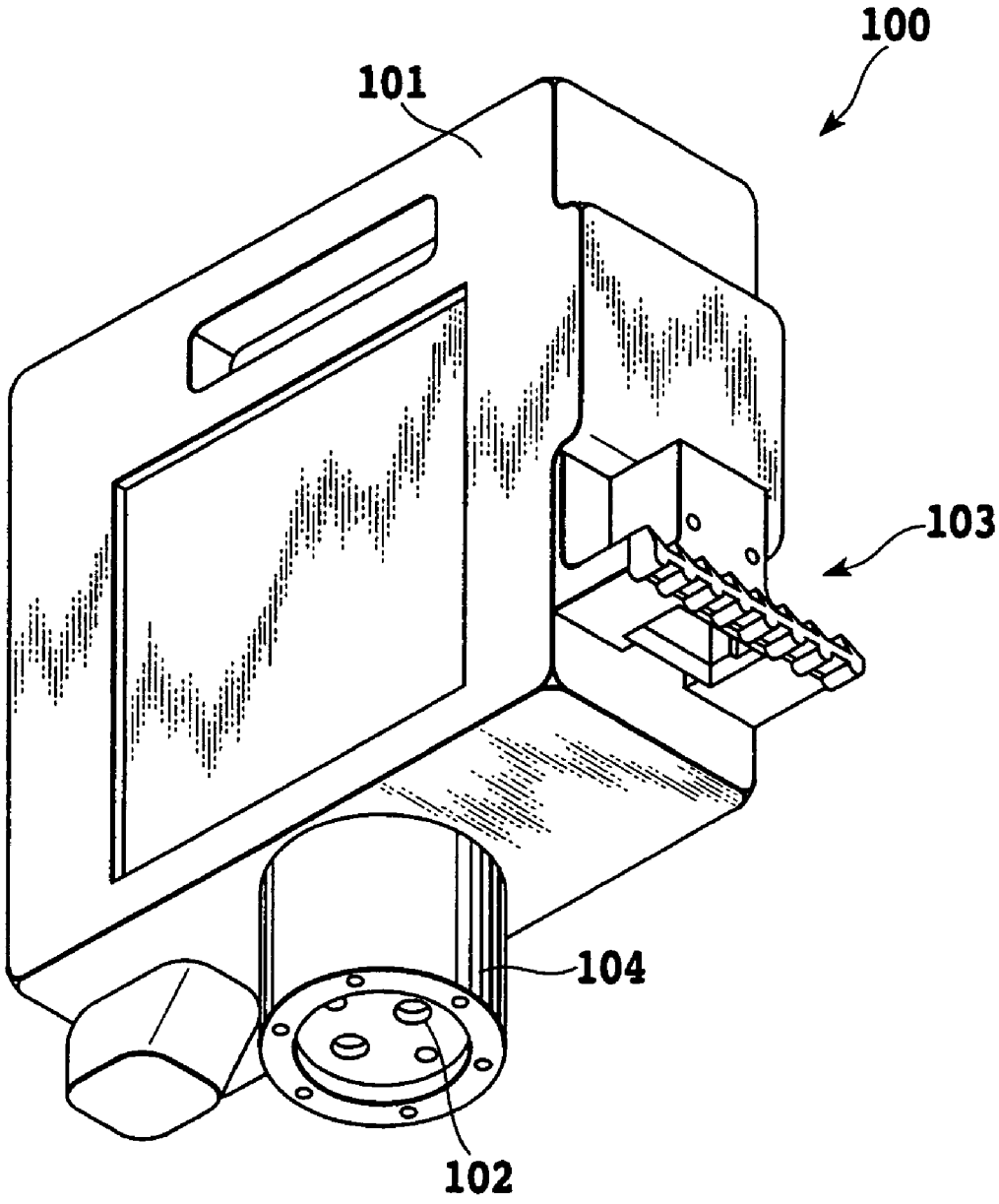
FIG. 1 is a perspective view of an ink tank according to an embodiment of the present invention.
Figure 2:
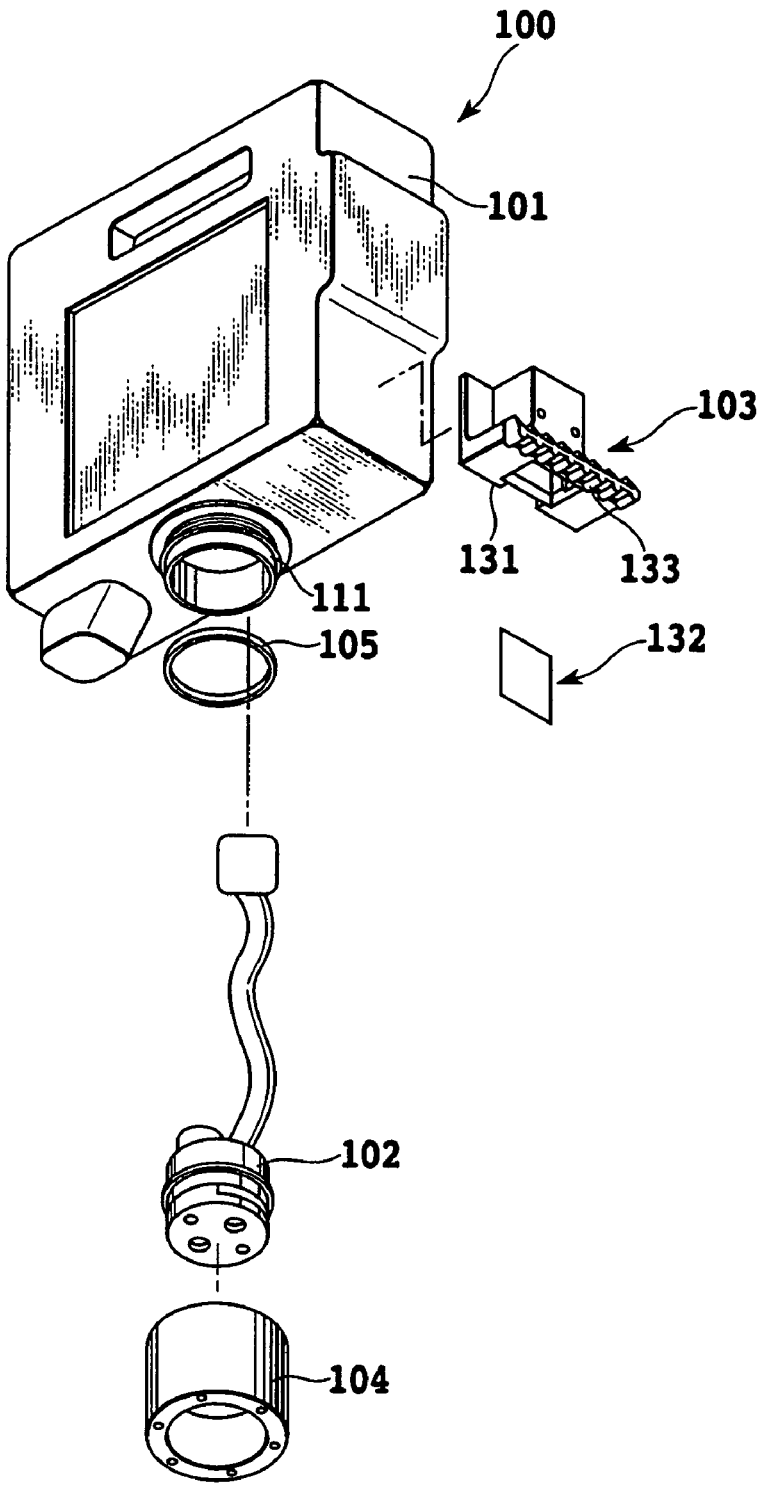
FIG. 2 is a an exploded perspective view of a connecting unit and a cap member in FIG. 1.

FIG. 1 is a perspective view of an ink tank according to an embodiment of the present invention, and FIG. 2 is an exploded perspective view of a connecting unit and a cap member.

Roughly speaking, the ink tank 100 is constructed by an ink container 101, a connecting unit 102 for taking out liquid from the ink container 101, an information storage medium unit 103 for reading various information regarding the ink tank 100, a cap member 104, and ink 1000 using pigment as a colorant.

When the ink tank 100 is attached to the ink jet printer, a hollow needle for supplying ink and a hollow needle for introducing air provided in the ink jet printer are inserted into the tank, and the ink is supplied by the communication of these hollow needles with the ink stored in the interior of the ink tank.

The connecting unit 102 has a connecting section through which the ink-supply hollow needle and the air-introduction hollow needle are inserted from the ink jet printer side. The connecting unit 102 is pressed to be in air-tight contact onto an opening section 111 of the ink container 101 via a seal member 105. The cap member 104 and the opening section 111 of the ink tank are threaded, respectively, so that the cap member 104 is screwed with a male thread provided on the outer circumference of the opening section 111 via the seal member 105 to hold the connecting unit 102 in the tight contact with the opening section 111 under pressure.

In this regard, a structure of the connecting unit 102 and an ink-supplying method will be described in more detail later.

The information storage medium unit 103 includes an information storage medium holder 131 and information storage medium 132 fixed to the information storage medium holder 131 with an adhesive tape (not shown). The information storage medium holder 131 also has a function of mechanical ID to coincide with a specific position of the ink jet printer by cutting a notched section 133 to have a desired pattern. Accordingly, it is possible to prevent the ink tank from being erroneously inserted into a position for another color even if there are a plurality of ink colors.

Figure 3:
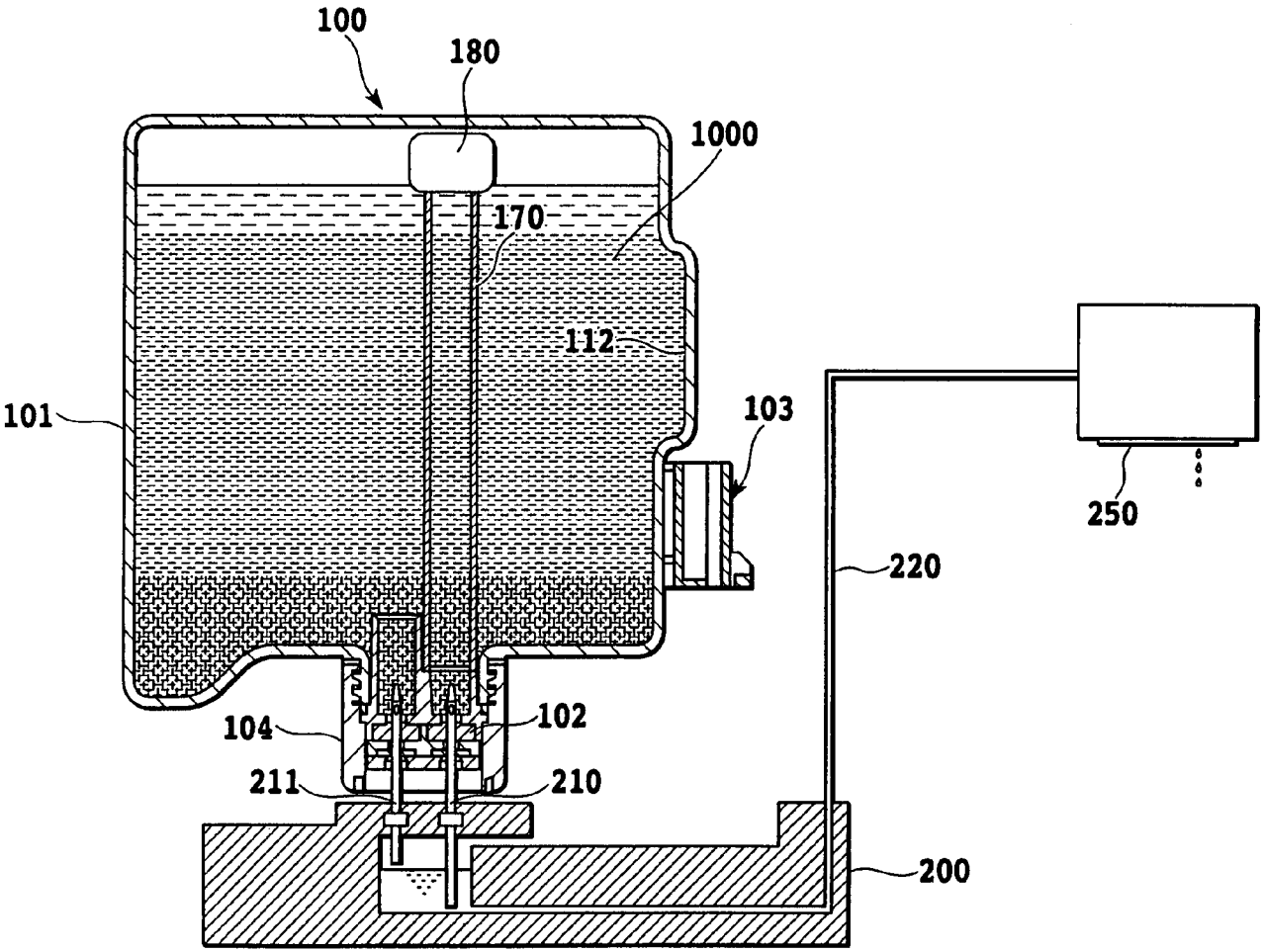
FIG. 3 is a schematic view illustrating a structure of an ink-supply system as a whole when the ink tank is mounted to an ink jet printer.

FIG. 3 is a schematic view illustrating a structure of an ink-supply system as a whole when the ink tank is mounted to the ink jet printer.

Reference numeral 100 denotes an ink tank and 200 denotes an ink jet printer (part thereof is solely shown). The ink tank 100 is mounted to the ink jet printer 200 by piercing the connecting unit 102 provided in the ink tank 100 by an ink-supply needle 210 and an air-introduction needle 211 provided in the ink jet printer 200 into an ink storage chamber 112. A printing head 250 and the ink tank 100 are communicated with each other via the ink-supply needle 210 and an ink-supply path 220. As the ink in the printing head 250 has been consumed and a negative pressure has been generated in the printing head 250, the ink 1000 in the ink storage chamber 112 passes the ink-supply needle 210 and is guided to the printing head 250 via the ink-supply path 220. As the ink 1000 in the ink storage chamber 112 is conveyed to the printing head 250, the negative pressure is generated in the ink storage chamber 112. However, since air is introduced into the ink storage chamber 112 from the air-introduction needle 211, the interior pressure of the ink storage chamber 112 is recovered. By repeating such a cycle during the printing operation, the ink supply can be smoothly continued.

Next, the printing operation carried out by the printing head 250 is as follows:

The printing head 250 has a nozzle surface having a plurality of nozzles thereon and opposed to the printing medium (not shown). More concretely, the printing medium is conveyed to a position opposed to the printing head from a paper-feeding section by the rotation of a paper-feed roller (not shown) or the like. In this regard, the printing head in this embodiment is of a serial type. A guide rail (not shown) is bridged over a width of the printing medium, and the printing head ejects ink onto the printing medium while moving along the guide rail to carry out the printing operation (this motion is referred to as "a printing scan" hereinafter). When the printing head moves along the guide rail from one end to the other end of the printing medium, the printing medium is conveyed at a distance corresponding to a width of the printing head by the rotation of the feed roller or the like (this motion is referred to as "a paper feed"). By alternately repeating the printing scan of the printing head and the paper feed, it is possible to form an image entirely over the printing medium. The ink-supply path 220 is formed of a flexible material such as a rubber tube, and preferably has a length not to disturb the scanning motion of the printing head. The ink jet printer to which the present invention is applied is not limited to that having a serial type printing head but may include any other ink jet printers, for example, having a full-line type printing head.

Figure 4:
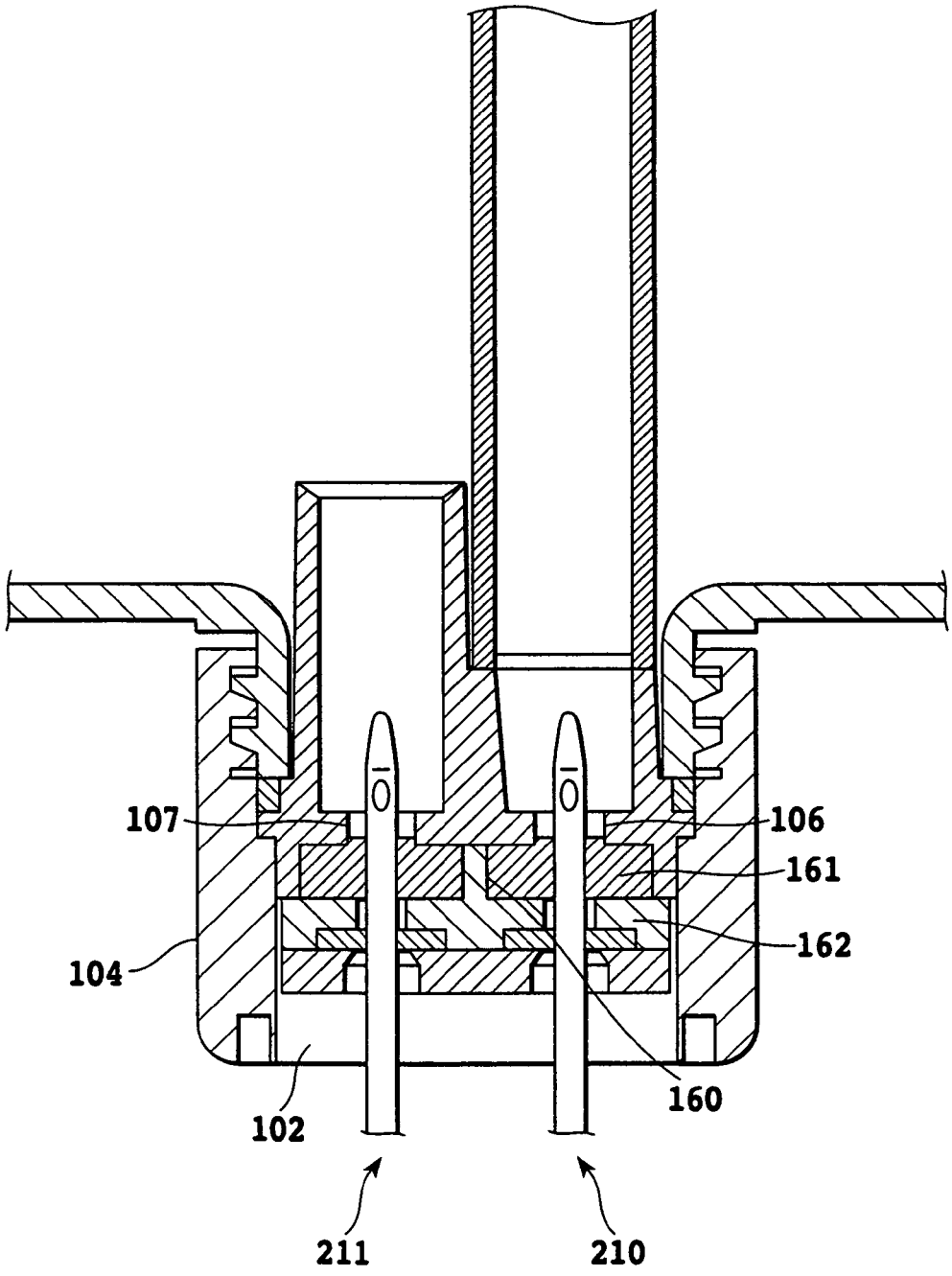
FIG. 4 is a sectional view of the connecting unit which is a joint section with the ink jet printer.

FIG. 4 is an enlarged side sectional view illustrating a detailed structure of the connecting unit which is a joint section with the ink jet printer.

Reference numeral 106 denotes an ink-supply port into which the ink-supply needle 210 is inserted. Reference numeral 107 denotes the air-introduction port into which the air-introduction needle 211 is inserted. Since the structures of the ink-supply port 106 and the air-introduction port 107 are substantially the same, the explanation will be made solely on the ink-supply port 106. A cylindrical housing 160 is provided in the ink-supply port 106, and a dome-shaped elastic member 161 is assembled therewith. Further, a fixing member 162 is fixed to the elastic member 161 by an ultrasonic welding so that the ink-supply port 106 is defined by pressing the elastic member 161 with the fixing member 162. By pressing the elastic member 161 with the fixing member 162, the elastic member 161 tends to be widened in the radial direction. Since this widening force is suppresses by the housing 160, the elastic member 161 is in a radially compressed state. Thereby, the elastic member 161 is brought into tight contact with the housing 160 without any gap. Thus, the unintentional leakage of the ink from the gap is avoidable. Also, although the ink-supply needle 210 forms a through-hole in the elastic member 161 by the insertion thereof, this through-hole is closed due to the elasticity immediately after the ink-supply needle 210 has been withdrawn. Thus, the leakage and dropping of the ink are also avoidable.

Means for supplying ink to the ink-supply needle in the ink tank of the above-mentioned structure will be described below.

With reference again to FIG. 3, a hollow tubular member 170 is connected to the ink-supply port 106 into which the ink-supply needle 210 is inserted. A float 180 made of a material having a buoyancy not sinking in the ink is attached to one end of the tubular member 170. A length of the tubular member is selected to be larger than a height of the ink surface at the initial stage from the bottom of the ink tank so that the float 180 always can floats on the ink surface. The tubular member is provided with ink-supply holes, from which the ink is collected and sent to the printing head via the ink-supply needle.

While the ink surface level descends in the vertical direction as the ink is consumed, the position of the float 180 also descends therewith, whereby the tubular member disposed between the float 180 and the bottom of the ink tank always exists in the ink. As described before, the ink is divided into several concentration layers, in which the concentration is highest in the layer at the bottom of the ink tank and becomes lower as closer to the ink surface. Accordingly, by suitably selecting the material of the tubular member and the position of the ink-supply hole, it is possible to always supply ink having a constant concentration. The operation for taking ink into the tubular member will be explained below with reference to the preferred examples.

In this regard, in methods described in Examples 1 and 2, the high concentration ink in the vicinity of the bottom of the ink tank and the low concentration ink in the vicinity of the float are collected and mixed to be the medium concentration ink. On the other hand, in Example 3, a method is described, in which the medium concentration ink is supplied by always collecting ink from the medium concentration layer even if the level of the ink surface would change.

EXAMPLE 1

Figure 5A:
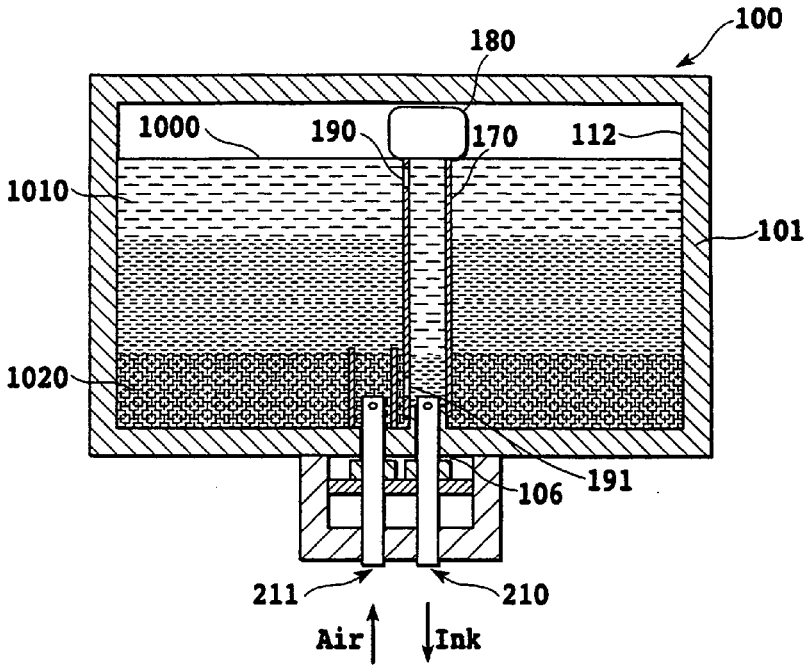
FIG. 5A is a schematic view illustrating the interior of the ink tank at an initial stage of the use.
Figure 5B:
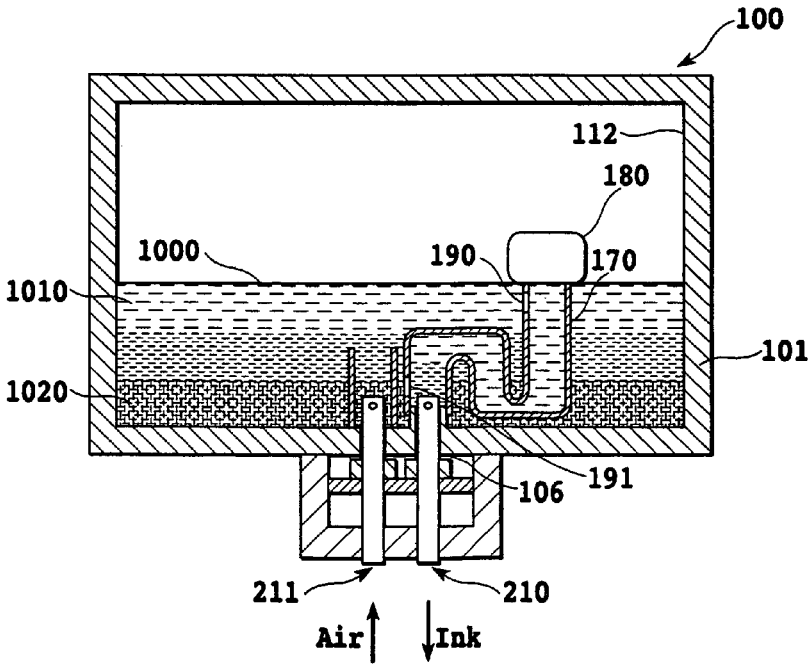
FIG. 5B is a schematic view illustrating the interior of the ink tank when half an amount or more of ink has been consumed.

FIGS. 5A and 5B are schematic views illustrating the interior of the ink tank in this Example.

FIG. 5A illustrates the ink tank at the initial stage of the use, in which a sufficient amount of ink is still stored. On the other hand, FIG. 5B illustrates the ink tank, in which half an amount of ink or more has been consumed.

Reference numeral 170 denotes the hollow tubular member made of elastic material capable of freely bending. One end of the tubular member 170 is connected to the ink-supply port 106 to form a path to the ink-supply port 106. The float 180 is attached to the other end of the tubular member 170 to close the tubular member 170.

As described above, the material of the tubular member 170 is an elastic material and has a specific gravity larger than that of the ink 1000 stored in the ink tank. A length of the tubular member 170 is selected to be larger than a height of the ink surface level at the initial stage of the use from the bottom of the ink storage chamber 112. The float 180 is made of material having the buoyancy not sinking in the ink. By using the tubular member 170 and the float 180 of such a shape and made of such material, the tubular member 170 is located to extend upward in the ink tank 100. While silicone is adopted for the tubular member in this Example, by taking the ink affinity thereof into account, any other material may be used provided it has the good ink affinity and are freely flexible. While polypropylene is adopted for the float in view of the ink affinity thereof in a similar manner to the tubular member, any other material may be used provided it has a buoyancy capable of keeping the float not to sink in the ink. Even if the ink 1000 in the ink storage chamber 112 has been consumed to lower the ink surface level under such a condition, as shown in FIG. 5B, the float 180 of the tubular member 170 is always maintained to float on the ink surface and the tubular member 170 located under the ink surface is bent to lie down on the bottom of the ink storage chamber 112.

The tubular member 170 has two ink-supply holes; a first ink-supply hole 190 opened in the vicinity of the float 180 and a second ink-supply hole 191 opened in the vicinity of the bottom of the ink storage 112. Thus, even if particles of the pigment used as a colorant are settled out, a low pigment concentration ink 1010 in the vicinity of the ink surface and a high pigment concentration ink 1020 in the vicinity of the bottom of the ink storage chamber are collected therethrough and mixed in the tubular member 170 so that a uniform ink 1000 having a medium pigment concentration is always supplied to the printing head.

In this regard, if sizes of the first ink-supply hole 190 and the second ink-supply hole 191 are identical, more ink is taken into the tubular member 170 from the second ink-supply hole 191 due to the pressure difference caused by the head difference. To solve such an inconvenience, according to this Example, a cross-sectional area S1 of the first ink-supply hole 190 and that S2 of the second ink-supply hole 191 are determined to be S1>S2 so that the flow rate of the ink flowing through the respective ink-supply hole into the tubular member 170 is adjusted to form the medium pigment concentration ink in the vicinity of the ink-supply port 106.

Also, as shown in FIG. 5B, when the ink 1000 in the ink tank 100 is constantly consumed by the large volume printing operation under the condition in which the pigment is settled out, or when the ink jet printer has not been used for a long time after a certain amount of the ink 1000 in the ink tank 100 has been consumed to lower the ink surface level, the ink is separated to layers having different pigment concentrations while the ink surface level is lowered. Since the float 180 moves in conformity with change of the ink surface, it is possible to take out the low pigment concentration ink 1010 from the first ink-supply hole 190 in the vicinity of the float, while take out the high pigment concentration ink 1020 from the second ink-supply hole 191 in the vicinity of the bottom, even if the tubular member 170 is in a bending state, whereby the medium pigment concentration is obtainable in the vicinity of the ink-supply port 106 in the interior of the tubular member 170. Thus, the ink 1000 having a uniform pigment concentration is supplied to the printing head. In such a manner, since the first ink-supply hole 190 is always located in the low pigment concentration layer and the second ink-supply hole 191 always located in the high pigment concentration layer even if the ink surface level varies, it is possible to always supply the ink having the uniform concentration to the printing head as a result. Accordingly, even if the ink jet printer is used under any conditions, it is possible to provide a reliable printed product which has no concentration irregularity.

EXAMPLE 2

The connecting unit is attached to the vertical underside of the ink tank in Example 1. Contrarily, in Example 2, an ink-supply mechanism in which the connecting unit is located upper side of the ink tank so that the ink stored in the ink tank is pumped up will be described.

Figure 6:
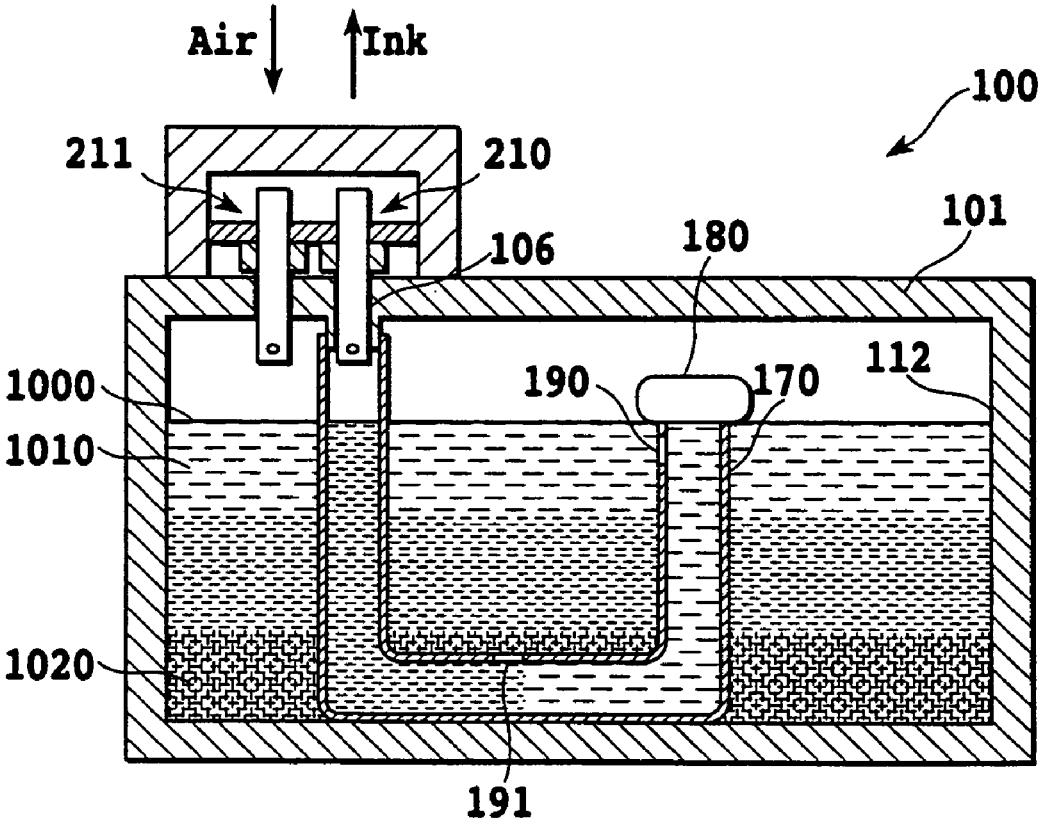
FIG. 6 is a schematic view illustrating the interior of the ink tank according to a second embodiment of the present invention.

FIG. 6 is a schematic view illustrating the interior of the ink tank according to this Example.

In this structure, the connecting unit 102 which is a joint between the ink tank and the ink jet printer 200 is provided in the upper portion of the ink tank 100. In this case, a length of the tubular member 170 must be a height of the ink storage chamber 112 plus an ink surface level at an initial stage or more. The first ink-supply hole 190 is provided in the vicinity of the float 180, and the second ink-supply hole 191 is provided in the vicinity of the bottom of the ink storage chamber; that is, generally at a middle position of the length of the tubular member 170. The structure is the same as that in Example 1, except for the above-mentioned structural members.

Similarly to Example 1, according to this structure, since the float 180 is movable in conformity with the movement of the ink surface level, the low pigment concentration ink 1010 is always collected through the first ink-supply hole 190 and the high pigment concentration ink 1020 is always collected through the second ink-supply hole 191.

Since the ink flowing in through the first ink-supply hole 190 has a low pigment concentration, the low pigment concentration ink exists in the interior of the tubular member generally between the float 180 and the second ink-supply hole 191. However, since the high pigment concentration ink flows in through the second ink-supply hole 191, the high pigment concentration ink and the low pigment concentration ink are mixed together to have a medium pigment concentration, which ink exists in the interior of the tubular member generally between the second ink-supply hole 191 and the ink-supply port 106. Thus, the ink fed from the ink-supply port 106 always has the pigment concentration uniformized to the medium level.

In the above-mentioned Examples 1 and 2, since the ink is always collected at the highest and lowest positions of the ink surface level, no problem occurs even though a middle portion of the tubular member is in any posture. Also, since the vicinity of the float is always highest and the vicinity of the bottom of the ink tank is always lowest even if the ink surface level changes, it is unnecessary to vary a length of the tubular member provided the ink-supply holes are formed at the above-mentioned two positions.

EXAMPLE 3

In Examples 1 and 2, the high pigment concentration ink and the low pigment concentration ink are taken into the tubular member from two different ink-supply holes and mixed together in the tubular member, and the medium pigment concentration ink thus obtained is fed to the printing head. An alternative method may be thought for the purpose of always supplying the ink having the medium pigment concentration, in that the ink is collected from the ink layer originally having the medium pigment concentration. According to this Example, a structure for always collecting ink from the ink layer originally having the medium pigment concentration will be described. In this Example, the structure of the tubular member is different from those in Examples 1 and 2, so that a length of the tubular member is variable to always shift the ink-supply hole to a position corresponding to the ink layer having the medium pigment concentration.

Figure 7A:
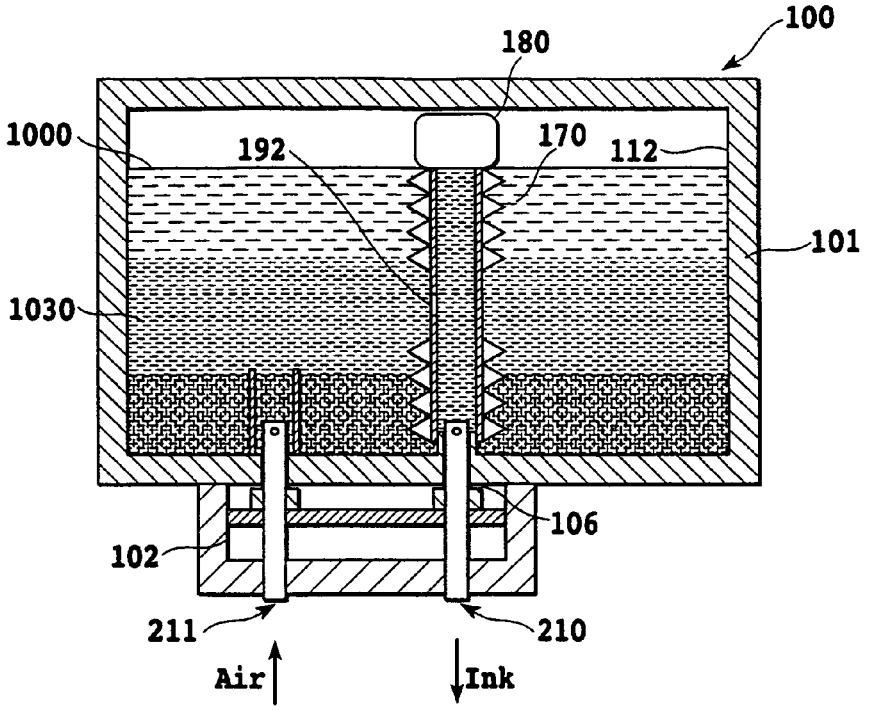
FIG. 7A is a schematic view illustrating the interior of the ink tank according to a third embodiment of the present invention at an initial stage of the use.
Figure 7B:
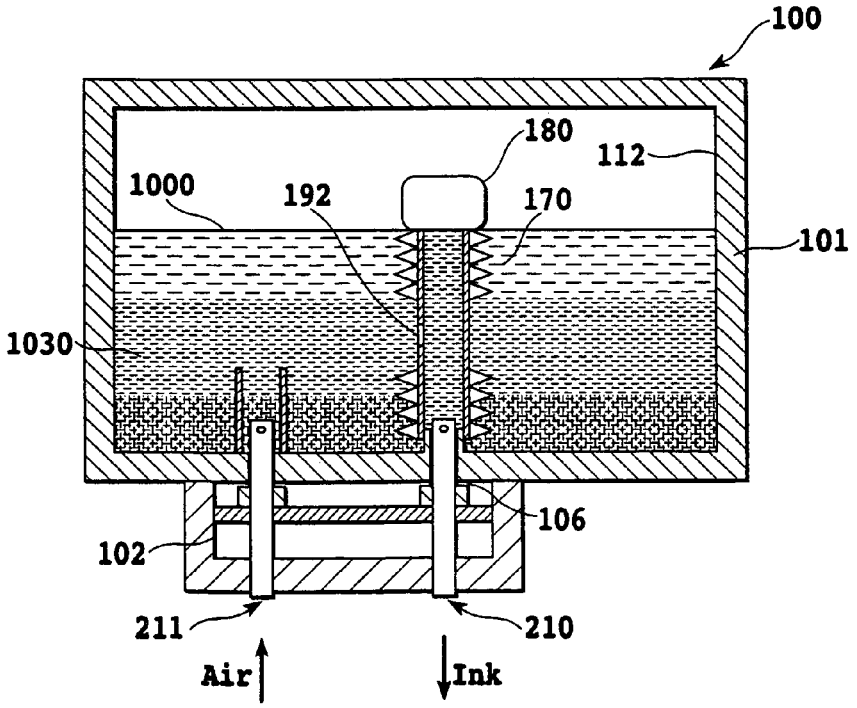
FIG. 7B is a schematic view illustrating the interior of the ink tank according to the third embodiment when the ink has been consumed to lower the ink surface level.
Figure 8:
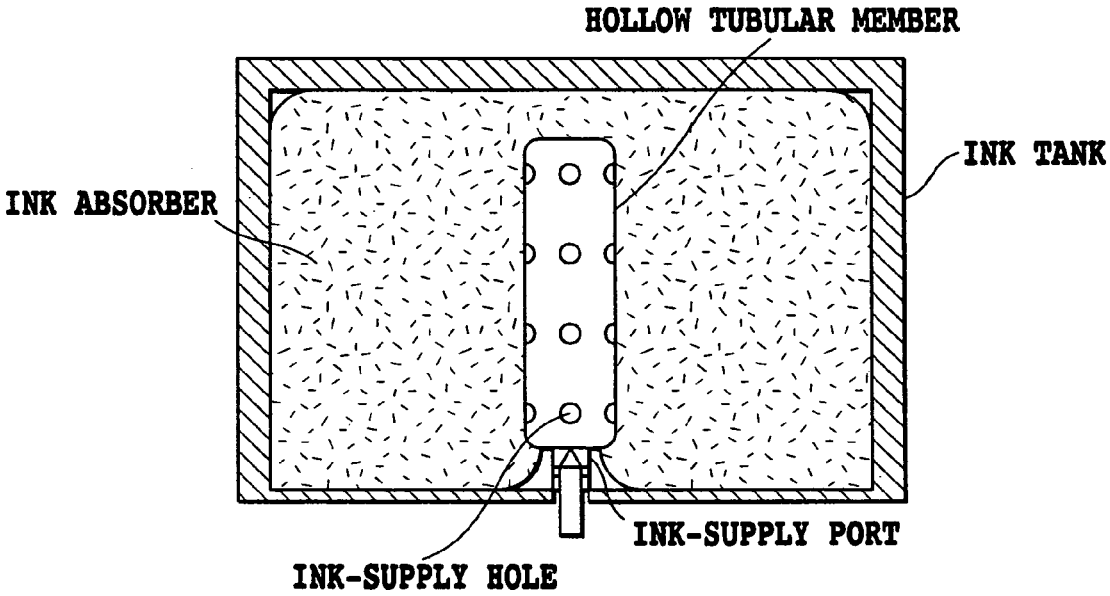
FIG. 8 is a schematic view illustrating the interior of the conventional ink tank.
Figure 9A:
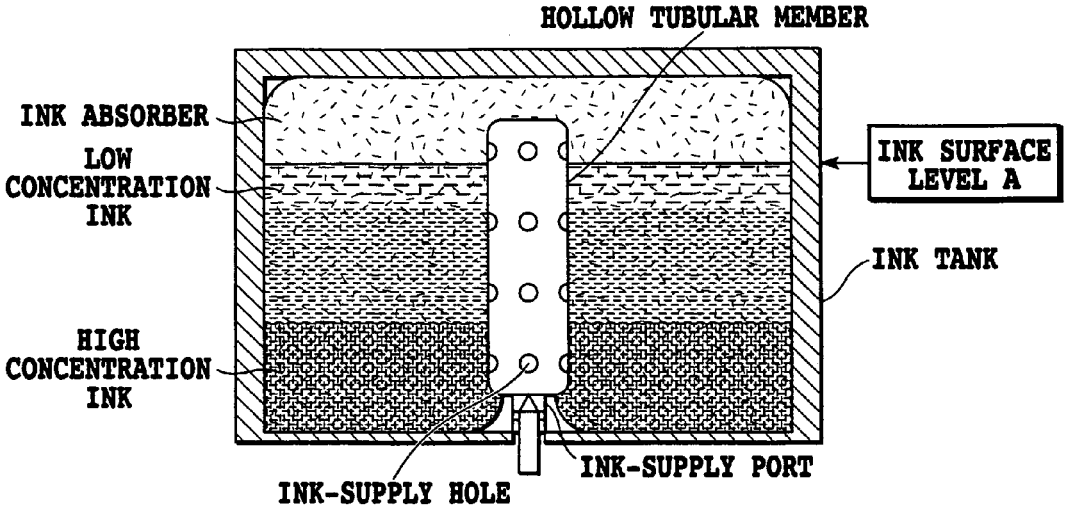
FIG. 9A is a schematic view illustrating the interior of the ink tank shown in FIG. 8 when the ink has been consumed to lower the ink surface level.
Figure 9B:
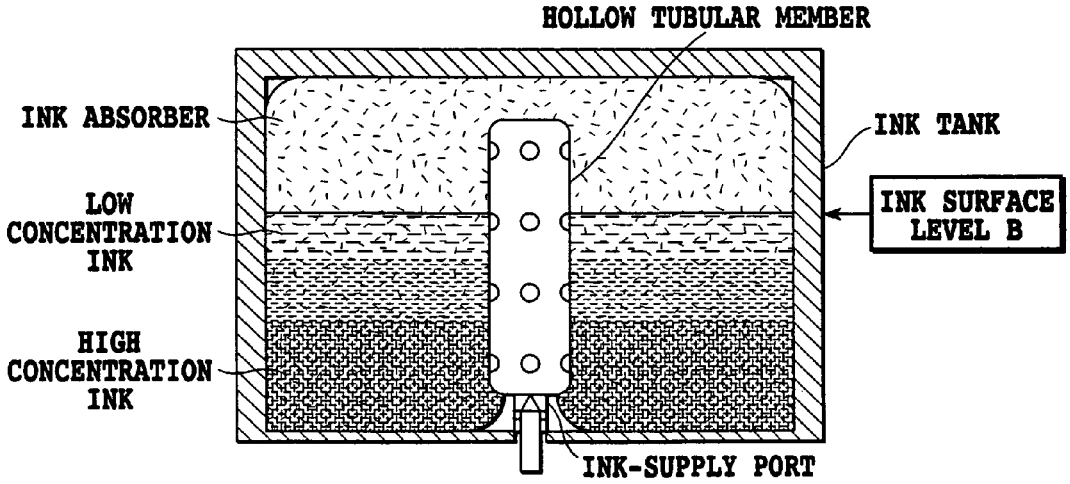
FIG. 9B is a schematic view illustrating the interior of the ink tank shown in FIG. 8 when the ink has been consumed to lower the ink surface level.

FIGS. 7A and 7B are schematic views illustrating the interior of the ink tank of this Example. FIG. 7A is a sectional view of the ink tank at the initial stage of the use and FIG. 7B is a sectional view of the ink tank in which the ink has been consumed and the ink surface level is lowered. The connecting unit 102 which is a joint portion with the ink jet printer is attached to the bottom of the ink tank 100.

A contour of the tubular member 170 is of a bellows shape and the interior thereof is hollow similarly to Examples 1 and 2. A length of the tubular member is generally identical to the ink surface level when the bellows is completely stretched. A single ink-supply hole 192 is formed generally at a middle position of the length of the tubular member 170, and an area of the tubular member 170 in the vicinity of the ink-supply hole 192 is not of the bellows shape but cylindrical. Except for the above points, Example 3 is structured in the same manner as Example 1.

In this regard, the tubular member 170 including the bellows portion and the cylindrical portion is formed of a deformable material such as a silicone tube. However, the cylindrical portion has a proper rigidity not to deform and close the ink-supply hole 192 due to a weight of the upper bellows portion. The material for the tubular member 170 is not be limited to the silicone tube but may be any other ones provided they satisfy the above conditions.

The supply of the ink 1000 to the printing head is carried out so that the ink 1000 flows through the ink-supply hole 192 and passes an ink-supply path. Also in this Example, the tubular member 170 is maintained to extend upward from the bottom of the ink tank 100 due to the buoyancy of the float 180 on the ink 1000.

At the initial stage of the use of the ink tank 100 as shown in FIG. 7A, the ink-supply hole 192 is located generally at a middle height position of the ink surface level. Thereby, the ink is sucked from the middle layer 1030 having the pigment concentration closer to the standard pigment concentration, is supplied to the printing head.

Even if the ink surface level is lowered as the ink has been consumed, as shown in FIG. 7B, the two bellows portions provided while interposing the ink-supply hole 192 of the tubular member 170 between them are collapsed to shift the ink-supply hole 192 to the middle height position of the ink surface level at the present time. Accordingly, it is possible to feed the ink 1000 from the middle layer 1030 having the pigment concentration closer to the standard pigment concentration.

If the ink surface level further descends to completely collapse the bellows, part of the tubular member is flexed due to the elasticity thereof, and the ink-supply hole is still positioned in the middle layer 1030.

In this Example, the upper and lower portions of the tubular member are contracted in accordance with the change of the ink surface level for the purpose of positioning the ink-supply hole in the ink layer at a middle height of the ink surface level. Accordingly, it is possible to always collect ink from the ink layer having the medium pigment concentration. Thereby, it is possible to feed the ink having the same pigment concentration to the printing head throughout the use from the initial stage to the final stage.

Means for contracting the tubular member is not limited to the bellows but may be any other means.

As described above, since the inventive liquid storage container is capable of always collecting the liquid from the liquid layer having the same pigment concentration into the tubular member and feeding the liquid having the constant pigment concentration to the printing head or the like, it is possible to use the liquid in the liquid storage container throughout the use from the initial stage to the final stage at the uniform pigment concentration. Since the pigment concentration of the supplied ink is constant in the ink tank or the like, it is possible to always provide a uniform image free from the difference in tint between the initial stage and the final stage of the use.

Since a structure may be adopted, in which the position of the liquid-supply port (the ink-supply port in a case of the ink tank) is not restricted, it is possible to flexibly correspond to a profile of the apparatus to which the inventive liquid storage container is attached.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid storage container for storing liquid having a tendency of forming a plurality of concentration layers in static state, provided with a liquid-supply port for supplying the liquid to another device, comprising:

a hollow tubular member disposed in the interior of the liquid storage container and connected at one end to the liquid-supply port; and at least one liquid-supply hole formed in the tubular member, wherein a height of the at least one liquid-supply hole from the bottom of the liquid storage container varies in accordance with the change of a level of the liquid surface, whereby the liquid in a specific layer of the plurality of concentration layers is taken into the tubular member from the at least one liquid-supply hole.

2. A liquid storage container as defined by claim 1, wherein a height of the at least one liquid-supply hole formed at a specific position of the tubular member from the bottom of the liquid storage container varies in accordance with the change of the level of the liquid surface.

3. A liquid storage container as defined by claim 2, wherein the tubular member is formed of elastic material and connected with a float capable of floating on the liquid at the other end opposite to the end connected to the liquid-supply port; the tubular member being deformable in accordance with the level of the liquid surface.

4. A liquid storage container as defined by claim 3, wherein the liquid-supply hole is formed on the tubular member in the vicinity of the connecting portion between the tubular member and the float.

5. A liquid storage container as defined by claim 4, wherein the liquid-supply hole is formed at least two positions in the vicinity of a connecting portion between the tubular member and the float and in the vicinity of the bottom of the liquid storage container.

6. A liquid storage container as defined by claim 5, wherein the concentration of the liquid forms a plurality of concentration layers which concentration is higher as going to the bottom of the liquid storage container, and the liquid-supply hole formed in the vicinity of the connecting portion between the tubular member and the float always sucks the liquid having a relatively low concentration, and the liquid-supply hole formed in the vicinity of the bottom of the liquid storage container always sucks the liquid having a relatively high concentration into the tubular member.

7. A liquid storage container as defined by claim 3, wherein the liquid-supply port is provided in the bottom of the liquid storage container, and the liquid-supply hole is formed in a middle portion of the tubular member as seen in the vertical direction, and wherein an upper portion of the tubular member from the connecting portion with the float to the vicinity of the liquid-supply hole and a lower portion of the tubular member from the vicinity of the liquid-supply hole to the connecting portion with the liquid-supply port are deformable in accordance with the change in a liquid surface level.

8. A liquid storage container as defined by claim 7, wherein the upper and lower portions of the tubular member contract in accordance with the descent of the liquid surface level.

9. A liquid storage container as defined by claim 3, wherein the tubular member is formed of material sinkable in the liquid.

10. A liquid storage container as defined by claim 1, wherein the liquid is pigment ink.

11. An ink jet printer, to which the liquid storage container as defined by claim 10 is mounted, for carrying out the printing operation by ejecting ink to a printing medium, comprising ink-supply means communicating the liquid-supply port with the printing head, wherein the ink-supply means extracts a necessary amount of ink from the liquid storage container as the ink is consumed in the printing head and supplies the ink to the printing head.

* * * * *